United States Patent [19]

Keller

[11] Patent Number: 4,730,757

[45] Date of Patent: Mar. 15, 1988

[54] COLLAPSIBLE CLOTHES HANGER

[76] Inventor: Roger L. Keller, 5305 Palmetto, Houston, Tex. 77081

[21] Appl. No.: 48,349

[22] Filed: May 11, 1987

[51] Int. Cl.[4] ..... A47G 25/40

[52] U.S. Cl. ..... 223/94; 211/118

[58] Field of Search ..... 223/89, 90, 94; 211/118

[56] References Cited

U.S. PATENT DOCUMENTS

| | | | |
|---|---|---|---|
| 395,884 | 1/1889 | Donaldson | 223/94 |
| 890,023 | 6/1908 | Cazier et al. | 223/94 |
| 896,570 | 8/1908 | Noble | 223/94 |
| 1,097,889 | 5/1914 | Sommer | 223/94 |
| 2,569,726 | 10/1951 | McPherson | 223/94 |
| 2,653,739 | 9/1953 | Zenk | 223/94 |
| 2,872,090 | 2/1959 | Goodman | 223/94 |
| 3,315,854 | 4/1967 | Glisson et al. | 223/94 |

FOREIGN PATENT DOCUMENTS

| | | | |
|---|---|---|---|
| 733278 | 7/1932 | France | 223/94 |

*Primary Examiner*—Robert R. Mackey

*Attorney, Agent, or Firm*—Fulbright & Jaworski

[57] ABSTRACT

A first and second arm pivotally connected together at first ends for pivoting from an extended to a retracted position. Upwardly extending extensions are connected to the first ends and are connected to a resilient loop for resiliently holding the arms in the extended position but allowing the arms to be retracted downwardly. A supporting hook is connected to a pivot and provides a stop limiting the extended motion of the arms and also prevents the loop from moving past dead center of the pivot means.

3 Claims, 4 Drawing Figures

COLLAPSIBLE CLOTHES HANGER

BACKGROUND OF THE INVENTION

Clothes hanging on hangers are sometimes damaged or buttons popped as the clothes are pulled from the hangers. Hangers having spring biased arms have been proposed in various United States patents to overcome this problem by allowing the supporting arms to retract thereby facilitating the removal of the clothes from the arms. However, such prior art devices have been expensive, have been complicated, and have not met with public approval.

The present invention is directed to a collapsible clothes hanger which is inexpensive to manufacture, simple in construction and operation, and easy to use.

SUMMARY

The present invention is directed to a collapsible clothes hanger which includes a first and a second arm and pivoting means rotatably securing first ends of each of the arms together for pivoting the arms from an extended to a retracted position. The first ends include extensions extending upwardly above the pivoting means when the arms are extended. A supporting hook is connected to the pivoting means and is positioned to engage the extensions and limit their movement toward each other. Resilient tensioning means are connected to each of the extensions at a point above the pivoting means for resiliently holding the arms in the extended position but allowing the arms to be retracted downwardly.

Still a further object of the present invention is wherein the resilient means is a resilient loop such as a rubber band.

Still a further object of the present invention is wherein the extensions include notches on their outer periphery for connection to the resilient tensioning means.

Yet a still further object of the present invention is the inclusion of stop means connected to the supporting hook for preventing the middle of the resilient means from moving downwardly past the pivoting means.

Still a further object of the present invention is the provision of a supporting hook which includes an offset portion which extends between the extensions for providing a stop limiting the extended motion of the arms, and the offset portion extends below the resilient loop for preventing the middle of the loop from moving downwardly past the pivoting means.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENTS

Figure 2:
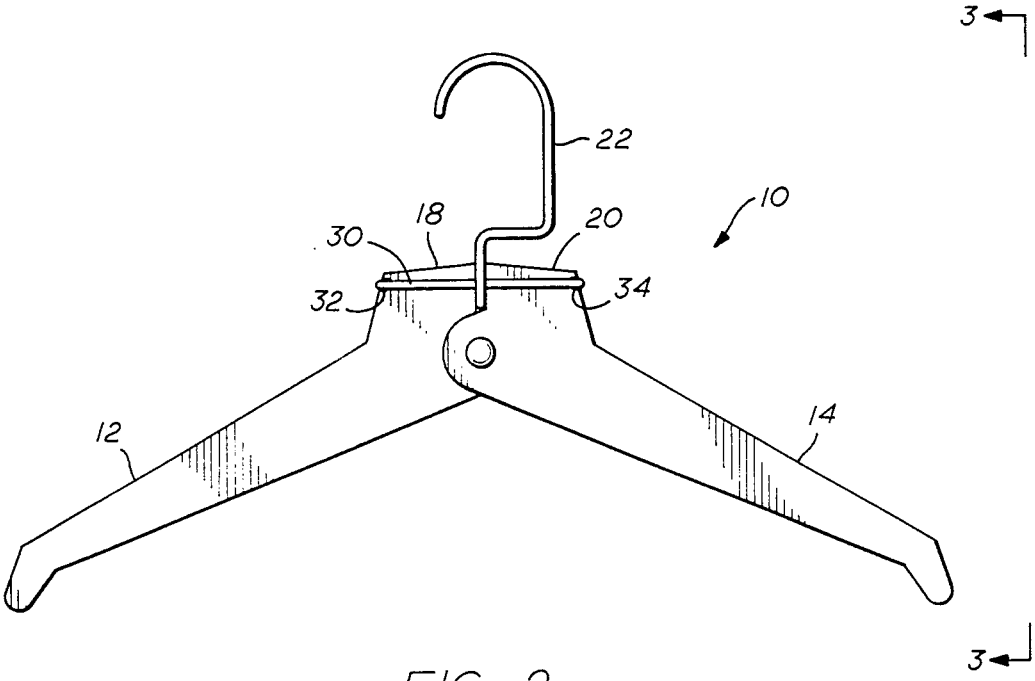
FIG. 2 is a front elevational view of the clothes hanger of FIG. 1.
Figure 3:
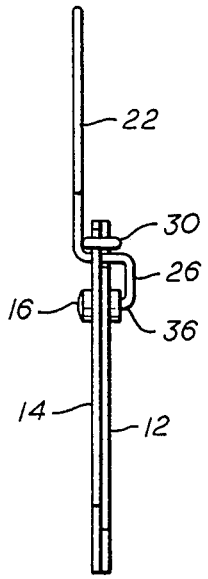
FIG. 3 is a side elevational view taken along the line 3—3 of FIG. 2.

Referring now to the drawings, the reference numeral 10 generally indicates the collapsible clothes hanger of the present invention and generally includes a first arm 12, and a second arm 14 which are rotationally secured to axle type pivoting means such as pivot pin 36 (FIG. 3). The first arm 12 and second arm 14 are secured to pivot pin 36 by a securing nut 16. Thus, the arms 12 and 14 may be rotatably pivoted about the pin 36 to an extended position, as best seen in FIGS. 1 and 2, for supporting clothes therefrom or may be pivoted to a retracted position, as best seen in FIG. 4, for removing clothes from the hanger 10 or inserting the hanger 10 into a garment.

The first ends of the arms 12 and 14 each include extensions extending upwardly above the pivot pin 36. Thus arm 12 includes an upwardly directed extension 18 and arm 14 includes an upwardly directed extension 20.

Figure 1:
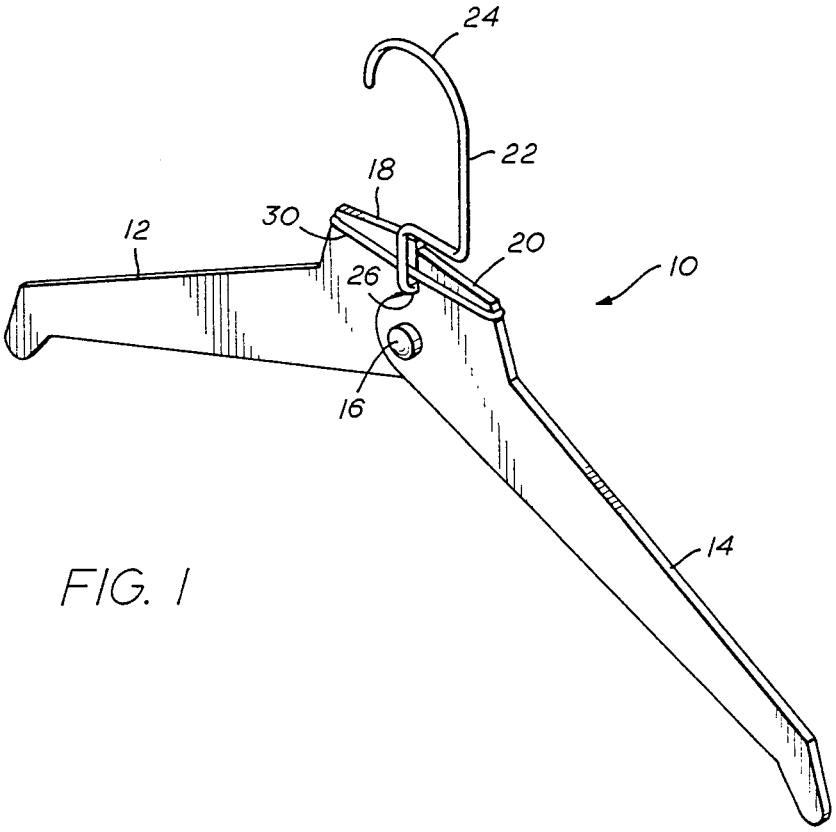
FIG. 1 is a prospective elevational view of the present invention shown in the extended position.

A supporting hook 22 is Provided which includes a hook portion 24 for supporting the hanger 10 from a conventional clothes rod and includes an offset portion 26, as best seen in FIGS. 1 and 3, which is in position to engage the extensions 18 and 20 and limit their movement towards each other thereby limiting the extended position of the arms 12 and 14.

Figure 4:
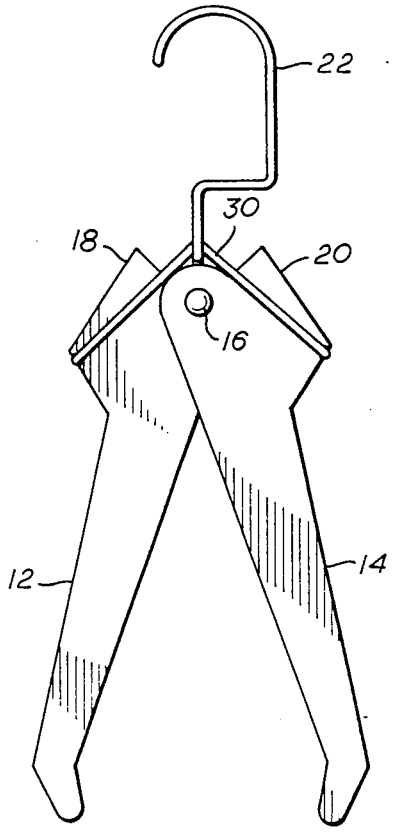
FIG. 4 is an elevational view of the clothes hanger of FIGS. 1 and 2 in the retracted position.

Resilient tensioning means 30, which is preferably a resilient loop such as a rubber band, is connected to each of the extensions 18 and 20 at a point above the pivoting means 36 for resiliently holding the arms in the extended position shown in FIGS. 1 and 2, but allowing the arms to be retracted downwardly as best seen in FIG. 4.

Preferably, the extensions 18 and 20 include notches 32 and 34, respectively in their outer peripheries for receiving and holding the resilient loop 30. It is to be noted that the offset portion 26 of the supporting hook 22 extends below the resilient loop 30 for preventing it from moving past a dead center position or below the pivoting pin 36 which would cause the arms to be locked in the retracted position.

While other types of resilient means may be used, the use of a rubber band 30 is particularly advantageous as it is a conveniently available item and can be easily replaced by the user in the event it fails.

In use, the hanger 10 will normally be in the position shown in FIGS. 1 and 2. By gripping the tops of the arms 12 and 14 they may be easily retracted and inserted into the neck of a clothes garment and will, when released, expand outwardly by the action of the resilient loop 30 until the extensions 18 and 20 engage the offset portion 26 of the supporting hook 22. In this position the strength of the loop 30 is sufficient to hold the arms 12 and 14 extended and support clothes therefrom. While the hanger 10 may be released from the garment by again gripping and moving the arms 12 and 14 towards each other, a garment can be removed by pulling the garment away from the supporting hook 22 and overcoming the biasing force of the rubber band loop 30 without damaging the clothes or ripping buttons therefrom.

The present invention, therefore, is well adapted to carry out the objects and attains the ends and advantages mentioned as well as others inherent therein. While a presently preferred embodiment of the invention has been given for the purpose of disclosure, numerous changes in the details of construction and arrangement of parts will be readily apparent to those skilled in the art, and which are encompassed within the spirit of the invention and the scope of the appended claims.

What I claim is:

1. A collapsible clothes hanger comprising, a first arm and a second arm having overlapping first ends, a pivoting axle rotatably securing said first ends of each of the arms together for pivoting the arms from an extended position to a downwardly retracted position, said first arms including extensions extending upwardly above the pivoting axle when the arms are extended, a supporting hook connected to the pivoting axle and having an offset portion above the pivoting axle which extends between the extensions for providing a stop limiting the extended motion of the arms, and a resilient loop connected around the extensions for resiliently holding the arms in the extended position but allowing the arms to be retracted downwardly, said loop positioned above said offset portion whereby said offset portion prevents the middle of the loop from moving downwardly past the pivoting axle when the arms are moved to a retracted downward position.

2. The apparatus of claim 1 wherein the loop is a rubber band.

3. The apparatus of claim 2 wherein the extensions include notches in the outer periphery for receiving the rubber band.

* * * * *